United States Patent [19]

Zisman et al.

[11] 3,957,672

[45] May 18, 1976

[54] DISPLACEMENT OF ORGANIC LIQUID FILMS FROM SOLID SURFACES BY NON AQUEOUS SYSTEMS

[75] Inventors: William A. Zisman, Silver Spring, Md.; Marianne K. Bernett, Alexandria, Va.

[73] Assignee: The United States of America as represented by the Secretary of the Navy, Washington, D.C.

[22] Filed: Nov. 23, 1973

[21] Appl. No.: 418,347

[52] U.S. Cl. ..... 252/171; 260/615 F

[51] Int. Cl.[2] ..... C11D 7/50

[58] Field of Search ..... 252/171, 170; 260/615 F, 615 BF; 134/34, 40

[56] References Cited

UNITED STATES PATENTS

| | | | |
|---|---|---|---|
| 3,167,514 | 1/1965 | Baker | 252/170 |
| 3,400,077 | 9/1968 | Orfeo et al. | 252/171 |
| 3,740,369 | 6/1973 | Proskow | 260/30.4 R |
| 3,755,530 | 8/1973 | Avila et al. | 423/22 |

*Primary Examiner*—William E. Schulz

*Attorney, Agent, or Firm*—R. S. Sciascia; Arthur L. Branning; Thomas McDonnell

[57] ABSTRACT

A non-aqueous liquid surface-active composition for displacing aqueous or organic liquid films from solid surfaces. The composition contains fluorinated polyethers having the formula $$CF_3CF_2CF_2[OCF(CF_3)CF_2]_nOCHFCF_3$$

and may include a fluoro-alcohol, or a fluoro-acid a fluorinated diester solute and/or a fluorinated benzene solvent, fully fluorinated bromo- and chloro-alkane solvent or a perfluoroalkane solvent.

11 Claims, No Drawings

DISPLACEMENT OF ORGANIC LIQUID FILMS FROM SOLID SURFACES BY NON AQUEOUS SYSTEMS

BACKGROUND OF THE INVENTION

This invention relates to a method and composition for surfacechemical displacing of liquid films from solid surfaces. The term film as used herein means a layer of an organic liquid or water which is physically adsorbed to a solid surface.

Typical procedure employed for removing oily films from solid surfaces of electrical, electronic or mechanical equipment involve spraying the solid surfaces with a solvent for the oily material or with an aqueous emulsion which contains a volatile solvent, a penetrant oil and a surface-active agent and functions through surface-chemical activity to displace the oily film.

The solvent film-removing procedure is simply a solvent-washing of the solid surface and depends essentially on the solubility of the oily material in the solvent.

The aqueous emulsion film-removing procedure requires spraying of the emulsion to the solid surface whereby the emulsion is broken on contact with the surface to release the penetrant oil which, with the assistance of the surface-active agent in the water of the emulsion, causes displacement of the oily films from the solid surface. The displacement of the oily film is followed by washing of the solid surface with water to remove residues of the oily film and of the applied emulsion. Optionally, the water-washing step is followed by spraying of a water-displacing composition to remove water from the washed surface.

The above prior art procedures require repeated spraying and, resultingly, the use of large amounts of the solvent or of the aqueous emulsion, as the case may be, to achieve a practical degree of displacement of the oily film from the solid surface. The aqueous emulsion procedure, additionally, has the disadvantages of introducing water which would prove detrimental or injurious in the cleaning of watches, meters and other fine mechanisms, optical equipment with sodium chloride windows, and electrical and electronic equipment containing parts which are damaged by water.

SUMMARY OF THE INVENTION

In accordance with the novel aspects of the invention liquid films i.e. organic liquids or water, are displaced from solid surfaces by the application thereto of a new surface-active composition containing $\alpha$ (perfluoropropyl)$\omega$ -(1,1,1,2poly[oxy(perfluoro-1,2-propylene]. This fluorinated polyether may be combined with fluoroalcohols, fluoroacids, fluorinated diesters and fully fluorinted bromo- and chloro-alkanes to form a solution capable of displacing liquid organic films and water from solid surfaces.

It is therefore an object of the invention to provide a novel method of displacing liquids from solid surfaces.

A further object of the invention is to provide a non-aqueous surface - active liquid composition capable of displacing liquids from solids. The displacing organic liquid composition must have the ability of cleansing the liquid from the surface of the solid with only small amounts of the displacing liquid being required.

Other objects, advantages and novel features of the invention will become apparent from the following detailed description of the invention.

DETAILED DESCRIPTION

In the practice of the method of the invention, the new liquid surface-active compositions may be applied by various procedures to the solid surfaces from which the liquid organic film is to be displaced, such as by spraying or flushing with the compositions or by dipping or immersing the surfaces in a bath of the compositions. Sprayed onto the solid surfaces, relatively small volumes of the liquid compositions will effectively displace liquid organic films from the surfaces, for example, a few cubic centimeters per 100 square inches of surface area.

The method may be performed using a fluorinated polyether produced by Dupont known as a FREON E SERIES FLUOROCARBON of the formula $$CF_3CF_2CF_2[OCF(CF_3)CF_2]_nOCHFCF_3,\ n=1...8$$

in its pure state or it may be performed using the above polyether, hereinafter referred to as OPFP-n, n being an integer from 1 to 8 as a solute, as a solvent or as a co-solvent.

In a single operation, the method displaces the liquid organic film from the solid surface and deposits thereon a mono-layer of the solute which prevents respreading of the displaced organic liquid over the solid surface for short, prolonged or indefinite periods of time depending on the solute in the liquid compositions employed. The rate of displacement of the liquid organic film from the solid surface will depend on the solvent and solute in the compositions and also on the organic liquid of the film to be displaced.

Suitable volatile solvents for OPEP-n are liquid perfluoro-alkanes, fluoro substituted benzenes, e.g. hexafluorobenzene and hexafluoroxylene and fully fluorinated bromo- and chloro-alkanes, for example, perfluoropentane, perfluorohexane, trichlorofluoromethane, dibromodifluoromethane, tribromofluoromethane, 1,1,2-trichloro-1,2,2-trifluoroethane, 1,2-dibromo-1,1,2,2-tetrafluoroethane, 1,1,1-trichloro-2,2,3,3,3-pentafluoropropane, 1,1,1,3-tetrachloro-2,2,3,3-tetrafluoropropane and 2,2,3-trichloro-1,1,1,3,4,4,4-heptafluorobutane and mixtures thereof, or liquid fully fluorinated bromo- or chloro-alkanes. The amount of OPFP-n solute required may be as little as 1 percent by volume.

The volatile solvent in the new liquid compositions serves as a convenient means to distribute the solute rapidly over the solid surface, aids actively in displacing the liquid organic film from the surface and evaporates quickly leaving the surface oil-and water-repellent.

When OPFP-n is used as a solvent, the solute may be a fluoroalcohol, a fluoromonocarboxylic acid, a partially fluorinated diester, or a fluorinated hydrocarbon. The amount of the solute in the compositions is small and may be varied with selection as to the amount being made on the basis of the liquid displacing activity of the particular solutes. In general, amounts of the solute which are in the range of from about 0.02 to 1 percent by weight of the compositions will be found effective for surface-chemical displacement of organic liquid films from solid surfaces by the method of the invention.

The method of the invention is effective to displace any liquid film from solid surfaces, for example, films of aliphatic and aromatic hydrocarbon oils, liquid fatty acids, liquid alcohols, liquid esters and ketones, etc., from surfaces of solids such as metals, glass, resins and polymers. Particular applications of the method are in the cleaning of oily films from solid surfaces of electrical equipment, such as electric motors, and electronic equipment. When the solute is a fluoroalcohol, a fluoromonocarboxylic acid, or a partially fluorinated diester, the method is also applicable to the cleaning of oily films from optical windows and solid surfaces of watches, meters and other fine mechanisms.

Fluoroalcohol solutes suitable for the OPFP-n compositions are perfluoroalcohols of the formula $$F(CF_2)_mCHROH$$

wherein R is a member of the group consisting of hydrogen and perfluoroalkyl radicals having from 1 to 11 carbon atoms and wherein m is an integer from 1 to 11, for example, perfluoroethanol-1, per fluorobutanol -1, per fluorooctanol-1, perfluoropropanol, perfluorooctanol-3, etc.; branched chain perfluoroalcohols of the formula $$(CF_3)_2CF(CF_2)_mCH_2OH$$

wherein m is an integer from 1 to 11, for example, 3-trifluoro-methylperfluorobutanol-1, 4-trifluoromethyl-perfluoropentanol-1, 7-trifluoromethyl-perfluorooctanol, etc.; partially flourinated alcohols of the formula:

$$F(CF_3)_m(CH_2)_nCH_2OH$$

wherein m is an integer from 1 to 10 and n is an integer from 1–15, for example, 3-trifluoromethyl-propanol-1;5,5,5,4,4 - pentafluoropentanol01; 8,8,8,7,7,6,6-heptaflurooctanol-1, etc; omega-hydroperfluoroalkl carbinols of the formula $$H(CF_2)_mCH_2OH$$

wherein m is an integer from 2–10, for example, omega-hydroperfluoroethyl carbinol-1, omega-hydroperfluorobutylcarbinol-1, omegahydroperfluorooctyl carbinol-1, omega-hydroperfluorodecyl carbinol-1, etc.; and branched chain omega-hydroperfluoroalkyl carbinols of the formula:

$$H(CF_2)_mCROH(CH_3)$$

wherein R is a member of the group consisting of hydrogen and methyl radical and m is an integer from 2 to 8, for example w-hydro-perfluorooctyl-2-ethanol, $H(CF_2)_4CHOH(CH)_3$ and $\omega$ -hydroperfluorooctyl-2-methyl-2-ethanol, $H(CF_2)_4COH(CH_3)_2$, etc.

Fluoroacid solutes suitable for the surface-active compositions are perfluoroalkyl monocarboxylic acids of the formula:

$$F(CF_2)_mCOOH$$

wherein m is an integer from 1 to 13, for example, trifluoroacetic acid, heptafluorobutyric acid, pentadecafluorooctanic acid, etc.; branch chain perfluoroalkyl monocarboxylic acids of the formulae:

$$(CF_3)_2CF(CF_2)_mCOOH \quad \text{and}$$
$$(CF_3)(CF_2Cl)CF(CF_2)_mCOOH$$

wherein m is an integer from 1 to 11, for example, 3-trifluoromethyl perfluorobutanoic acid, 3-difluorochloromethyl perfluorobutanoic acid, 13-trifluoromethyl perfluorotetradecanoic acid, etc.; partially fluorinated monocarboxylic acids of the formula:

$$F(CF_2)_m(CH_2)_nCOOH$$

wherein m is an integer from 1 to 10 and n is an integer from 2 to 16, for example, 4-trifluoromethyl-butanoic acid, 11-(heneicosafluorodecyl) -undecanoic acid, 17-(pentadecafluoroheptyl-heptadecanoic acid etc.; and partially fluorinated monocarboxlyic acids of the formula:

$$H(CF_2)_mCOOH$$

wherein m is an integer from 1 to 14, for example, 2H-difluoroacetic acid, 7H-dodecafluoroheptanoic acid, 11H-eicosafluoro undecanoic acid, etc.

Partially fluorinated aliphatic diesters for the new surface-active compositions have the formulae:

$$CH_2)_xCHR_1[COOCH_2(CF_2)_mF]_2$$

wherein $R_1$ is a member of the group consisting of hydrogen, $C_1$ to $C_{12}$ straight chain alkyl, $C_2$ to $C_{12}$ straight chain alkenyl, and phenyl radicals, m is an integer from 5 to 11 and x is an integer from 1 to 7, and $$(CH_2)_xCHR_1[COOCH_2(CF_2)_mH]_2$$

wherein $R_1$ and x have the values as above and m is an integer from 4 to 10. The acid portion of the diesters may be, for example a succinyl, glutaryl, adipyl, pimelyl, suberyl, azelyl or sebacyl radical; a methyl-, n-propyl-, n-butyl-, n-dodecyl-, n-octenyl, n-dodecenylsuccinyl radical, or phenylsuccinyl radical, a 3-methyl-, 3-butyl-, 3-dodecyl-, 3-octenylglutaryl radical, a 3-phenylglutaryl radical, a 4-methyl-, 4-octyl-, 4-phenyladipyl radical, a 7-methyl-, 7-ethylazelyl radical, a 7-phenyl azelyl radical, etc. The fluoro-alcohol portion of the diesters may be the residue of a perfluoroalcohol of the formula:

$$F(CF_2)_mCH_2OH$$

wherein m is an integer from 5 to 11 or of a partially fluorinated alcohol of the formula:

$$H(CF_2)_mCH_2OH$$

wherein m is an integer from 4 to 10. Among these diesters are, for example, bis(perfluorooctyl-n-dodecenyl succinate, bis(perfluorohexyl) -3-methylglutarate, bis(perfluorooctyl)-3-methylglutarate, bis(w-hydroperfluoroheptyl)-3-methylglutarate and -3-phenylglutarate, etc.

When the primary objective is displacement of liquid organic film from solid surfaces for short periods of time, e.g., ranging from a few minutes to about 24 hours, liquid surface-active composition may be used which contain a small amount, for example, from about 0.5 to 1 percent by weight, of the fluorinated polyether OPFP-n in a major amount of one of aforedefined volatile fluoroalkanes as the solvent or the polyether may be used as a solvent for one of the aforedefined fluoroalcohols. Further, pure OPFP-n may be used to achieve such a result. When $2 < n < 6$ the film will remain displaced for long periods of time. When n=1 or is greater than 6 the period of displacement will be less.

Typical of these compositions are those of the following specific examples in which parts are by volume.

| Example 1 | Percent |
|---|---|
| 1,1,2-Trichloro-1,2,2-Trifluoroethane | 99 |
| OPFP-2 | 1 |

| Example 2 | Percent |
|---|---|
| 1,1,2-Trichloro-1,2,2-Trifluoroethane | 99 |
| OPFP-6 | 1 |

| Example 3 | Percent |
|---|---|
| 7 | |
| OPFP-3 | 99.1 |
| Perfluorooctanol-1 | 0.9 |

Experiments were performed to test the compositions disclosed herein. Table I discloses the results of a few of those experiments. TABLE I: Behavior of Oxyperfluoropropylenes as Displacing Agents at 25°C

| Agent | Hexadecane | | Propylene carbonate | |
|---|---|---|---|---|
| | $\Sigma$max, cm² | $t_{max}$, min | $\Sigma$max, cm² | $t_{max}$, min |
| OPFP-1 | 12.6 | 1 | 4412 | 1 |
| OPFP-2 | 38.5 | 15 | 50.2 | 1 |
| OPFP-3 | 72.4 | 30 | 50.2 | 3 |
| OPFP-4 | 63.6 | 30 | 38.5 | 15 |
| OPFP-1 in solvent a | 0.8 | 1 | 0.8 | 1 |
| OPFP-2 in solvent a | 1.8 | 1 | 19.6 | 1 |
| OPFP-3 in solvent a | 4.9 | 3 | 33.2 | 3 |
| OPFP-2 in solvent a | 0.8 | 1 | 33.2 | 10 |
| solvent a | 0.8 | 1 | 1.8 | 1 |

[a]1% vol of OPFP in Trichloro-1,2,2-Trifluoroethane

The data was collected by covering a horizontal glass or stainless steel panel to a depth of 0.2 mm with the organic liquid to be displaced (n-hexadecane, bp 287° and propyl carbonate, bp 240°) and delivering a small drop of the pure displacing agent (here the OPFP or the solution) liquid to the wet surface from a clean platinum wire tip. Table I shows $\Sigma_{max}$, the maximum area of oil displacement, and $t$max, the time required to attain $\Sigma_{max}$ for each of the OPFP liquids. The large values of $\Sigma_{max}$ prove the OPFP liquids to be very effective liquid displacing agents.

Many efficient liquid displacing agents remain effective even when they are present as minor concentrations in a solvent. As can be seen in Table I, the OPFP liquids also remain effective, although to a much smaller degree, when dissolved in 1 percent volume concentrations in 1,1, 2-Trichloro-1,2,2,-Trifluoroethane.

Where it is desired to effect an indefinite or permanent type displacement of liquid organic films from solid surfaces, the solute in the liquid surface-active compositions is a fluoroacid of the formula, $$F(CF_2)_m(CH_2)_nCOOH$$

as defined above. The solute fluoroacid may be used in amounts of, for example, from about 0.02 to 0.1 percent by weight of the composition. These liquid compositions may be used for displacing liquid organic films from any solid surface since the solutes are only weakly acid due to the presence in the molecule of a long chain, $C_{10}$ to $C_{16}$, aliphatic hydrocarbon group between the electro-negative fluorine atoms and the carboxyl group. These compositions are illustrated by the following specific examples in which parts are by weight.

| Example 4 | Percent |
|---|---|
| OPFP-4 | 99.95 |
| $F(CF_2)_{10}(CH_2)_{10}COOH$ | 0.05 |

| Example 5 | Percent |
|---|---|
| OPFP-2 | 99.95 |
| $F(CF_2)_{10}(CH_2)_{10}COOH$ | 0.05 |

| Example 6 | Percent |
|---|---|
| OPFP-2 | 99.94 |
| $F(CF_2)_2(CH_2)_{10}COOH$ | 0.06 |

| Example 7 | Percent |
|---|---|
| OPFP-2 | 99.94 |
| $F(CF_2)_3(CH_2)_{16}COOH$ | 0.06 |

A glass or stainless steel panel coated with a film of organic liquid, was immersed in each of the above mentioned solutions for 5 to 45 minutes. When the panel was then retracted slowly from the solution it emerged slightly wet but dried within a few minutes, indicating that the solute had adsorbed on the solid surface as an oleophobic monomolecular layer which had displaced the organic liquid coating. In most cases the oleophobic film had adsorbed within the first 5 minutes of immersion, but once adsorbed, it prevented the organic liquid from respreading over the panel and could only be removed from the surface by abrasion.

The polyether may be used as a cosolvent for the solutes described above where the cosolvent is a volatile liquid solvent also described above. Since the cosolvents are mutually soluble the percentage of each cosolvent may vary greatly. It is preferrable however if the solute quantity remain rather low since its solubility in the cosolvents is not very high. Typical of these compositions are those of the following specific examples wherein percentages are by weight

| Example 8 | Percent |
|---|---|
| 1,1,2-Trichloro, 1,2,2-trifluoroethane | 66 |
| OPFP-2 | 33.97 |
| $F(CF_2)_{10}(CH_2)_{10}COOH$ | 0.03 |

| Example 9 | Percent |
|---|---|
| 1,1,2-Trichloro-1,2,2-trifluoroethane | 66 |
| OPFP-4 | 33.95 |
| $F(CF_2)_7(CH_2)_{16}COOH$ | 0.03 |

| Example 10 | Percent |
|---|---|
| 1,1,2-Trichloro-1,2,2-trifluoroethane | 66 |
| OPFP-4 | 33.95 |
| $F(CF_2)_2(CH_2)_{10}COOH$ | 0.05 |

Since the monolayers deposited by the liquid compositions of the invention are hydrophobic and oleophobic, appropriate compositions can be applied as adhesives, e.g., mold-release agents, or when the solute is a fluoroalcohol, a fluoromonocarboxlyic acid, or partially fluorinated diester, as dust-repellents on metals, glass, resins and polymers. Most of the deposited monolayers are effective in preventing or inhibiting subsequent corrosion of steel by the humid atmosphere.

For the displacing of liquid organic films from solid surfaces which are non-corrosive, i.e., those which do not readily oxidize; such as nickel, gold, platinum and rhodium and glass, resins and polymers, liquid surface-active compositions may be used in which the solute is a fluoroacid of the formulas, $F(CF_2)_mCOOH$, $H(CF_2)_mCOOH$, $(CF_3)_2CF(CF_2)_mCOOH$, $CF_3(CF_2Cl)CF(CF_2)_mCOOH$, as defined above. These solutes may be used in amounts of, for example, from about 0.08 to 1 percent by weight of the compositions in the fluorinated polyether solvent.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A non-aqueous liquid composition for displacing liquid films from solid surfaces which consists essentially of a. a fluorinated polyether having the formula $CF_3CF_2CF_2[OCF(CF_3)CF_2]_nOCHFCF_3$, where n is an integer from 1 to 8 and said fluorinated polyether is present in an amount from 1 to 100 percent by volume;

b. from 0 to 99 percent by volume of a solvent selected from the group consisting of volatile liquid perfluoroalkanes, volatile liquid fully fluorinated bromo- and chloro-alkanes, and fully substituted benzenes; and c. from 0 to 1 percent by weight of a solute selected from the group consisting of fluoroalcohols, fluoromonocarboxylic acids, partially fluorinated diesters.

2. A composition as defined by claim 1 wherein said solvent is 1,1,2-trichloro-1,2,2-trifluoroethane.

3. A composition as defined by claim 1 wherein said solute is selected from the group consisting of fluoroalcohols having the formula:

$$F(CF_2)_mCHROH$$

wherein m is an integer from 1 to 11, and R is a member of the group consisting of hydrogen and perfluoroalkyl radicals having from 1 to 11 carbon atoms, $$F(CF_2)_m(CH_2)_nCH_2OH$$

wherein m is an integer from 1 to 10 and n is an integer from 1 to 15, $$H(CF_2)_mCH_2OH$$

wherein m is an integer from 2 to 10, $$H(CF_2)_mCHOH(CH_3)$$

and $$H(CF_2)_mCOH(CH_3)_2$$

wherein m is an integer from 2 to 8, fluoromonocarboxylic acids of the formulae:

$$F(CF_2)_m(CH_2)_nCOOH$$

wherein m is an integer from 2 to 16, $$F(CF_2)_mCOOH$$

wherein m is an integer from 1 to 13, $$(CF_3)_2CF(CF_2)_mCOOH$$

and $$CF_3(CF_2Cl)CF(CF_2)_mCOOH$$

wherein m is an integer from 1 to 11, and $$H(CF_2)_mCOOH$$

wherein m is an integer from 1 to 14, partially fluorinated diesters of the formulae:

$$(CH_2)_xCHR_1[COOCH_2(CF_2)_mF]_2$$

wherein $R_1$ is a member of the group consisting of hydrogen, $C_1$ to $C_{12}$ straight chain alkyl, $C_2$ to $C_{12}$ straight chain alkenyl and phenyl radicals and m is an integer from 5 to 11, and $$(CH_2)_xCHR_1[COOCH_2(CF_2)_mH]_2$$

wherein $R_1$ and x have the values as above and m is an integer from 4 to 10.

4. A composition as defined in claim 3, wherein the solute is perfluorooctanol-1.

5. A composition as defined in claim 3, wherein the solute is $F(CF_2)_7(CH_2)_{16}COOH$.

6. A composition as defined in claim 3, wherein the solute is $F(CF_2)_{10}(CH_2)_{10}(CH_2)_{10}COOH$.

7. A non-aqueous liquid composition consisting essentially of 1,1,2-Trichloro-1,2,2-trifluoroethane, a fluorinated polyether having the formula:

$$CF_3CF_2CF_2[OCF(CF_3)CF_2]_nOCHFCF_3$$

wherein n is an integer from 1 to 8 and said polyether is present in an amount from 1 % to 99.98 % by volume, and a fluorinated monocarboxylic acid having the formula $F(CF_2)_m(CH_2)_nCOOH$, where m is an integer from 1 to 10, n is an integer from 1 to 8 and said acid is present in an amount from 0 to 1 percent by weight.

8. A composition as defined by claim 7 wherein said fluorinated polyether is $$CF_3CF_2CF_2[OCF(CF_3)CF_2]_2OCHFCF_3$$

and said acid is $F(CF_2)_{10}(CH_2)_{10}COOH$.

9. A composition as defined by claim 7 wherein said fluorinated polyether is $$CF_3CF_2CF_2[OCF(CF_3)CF_2]_4OCHFCF_3$$

and said acid is $F(CF_2)_7(CH_2)_{16}COOH$.

10. A composition as defined by claim 7 wherein said fluorinated polyether is $$CF_3CF_2CF_2[OCF(CF_3)CF_2]_4OCHFCF_3$$

and said acid is $F(CF_2)_3(CH_2)_{10}COOH$.

11. A method of displacing liquid films from solid surfaces which comprises applying to the solid surface a non-aqueous liquid composition which consists essentially of a. a fluorinated polyether having the formula $CF_3CF_2CF_2[OCF(CF_3)CF_2]_n$-$OCHFCF_3$, where n is an integer from 1 to 8 and said fluorinated polyether is present in an amount from 1% to 100% 1% by volume;

b. from 0 to 99 percent by volume of a solvent selected from the group consisting of volatile liquid perfluoroalkanes, volatile liquid fully fluorinated bromo- and chloro-alkanes and fluoro- substituted benzenes, and c. from 0 to 1 percent by weight of a solute selected from the group consisting of fluoroalcohols, fluoromonocarboxylic acids, a partially fluorinated diester.

* * * * *